US011774912B2

(12) United States Patent
Allimann et al.

(10) Patent No.: US 11,774,912 B2
(45) Date of Patent: Oct. 3, 2023

(54) DEVICE FOR FASTENING A BACK ON A MIDDLE FOR A TIMEPIECE

(71) Applicant: The Swatch Group Research and Development Ltd, Marin (CH)

(72) Inventors: Joël Allimann, Vallon (CH); Benjamin Chartrel, St-Blaise (CH)

(73) Assignee: The Swatch Group Research and Development Ltd, Marin (CH)

( * ) Notice: Subject to any disclaimer, the term of this patent is extended or adjusted under 35 U.S.C. 154(b) by 112 days.

(21) Appl. No.: 17/375,398

(22) Filed: Jul. 14, 2021

(65) Prior Publication Data

US 2022/0050421 A1 Feb. 17, 2022

(30) Foreign Application Priority Data

Aug. 17, 2020 (EP) ..... 20191389

(51) Int. Cl.
*G04B 37/00* (2006.01)

(52) U.S. Cl.
CPC ..... *G04B 37/0008* (2013.01)

(58) Field of Classification Search
CPC ..... G04B 37/11; G04B 37/0033; G04B 37/0008; G04B 37/08; G04B 37/0041
See application file for complete search history.

(56) References Cited

U.S. PATENT DOCUMENTS 6,275,450 B1 * 8/2001 Makiba ..... G04B 19/06 368/80
6,761,479 B2 * 7/2004 Meyrat ..... G04B 37/0033 368/310
11,126,142 B2 * 9/2021 Wahler ..... G04B 19/286
2008/0225650 A1 9/2008 Muller et al.
(Continued)

FOREIGN PATENT DOCUMENTS

CH 694 110 A5 7/2004
CH 702655 A2 8/2011
CN 201489293 U 5/2010
(Continued)

OTHER PUBLICATIONS

European Search Report dated Jan. 21, 2021 in European Application 20191389.4, filed on Aug. 17, 2020 (with English Translation of categories of cited document), 3 pages.
(Continued)

*Primary Examiner* — Edwin A. Leon
(74) *Attorney, Agent, or Firm* — Oblon, McClelland, Maier & Neustadt, L.L.P.

(57) ABSTRACT

A device is for fastening a back on a middle of a watch. The back has a shoulder forming a cover arranged to cover entirely partly with the middle and a body arranged to rest in the middle. The device includes at least one pin integral with the middle, a seal mounted between the back and the middle. The back includes, near its periphery, at least one groove, the pin being arranged to slide in the groove
(Continued)

between a first position, called the insertion position in which the back is free, and a second position called locking position in which the back is locked and positioned angularly relative to the middle. The groove includes at least one bump to form a hard point and increase the torque when the pin passes through the bump.

18 Claims, 4 Drawing Sheets

(56) References Cited

U.S. PATENT DOCUMENTS

2015/0346692 A1 12/2015 Bolzt

FOREIGN PATENT DOCUMENTS

| | | | |
|---|---|---|---|
| CN | 103177891 | A | 6/2013 |
| CN | 202975608 | U | 6/2013 |
| CN | 203365961 | U | 12/2013 |
| CN | 104970892 | A | 10/2015 |
| CN | 105814497 | A | 7/2016 |
| CN | 107390860 | A | 11/2017 |
| CN | 206725971 | U | 12/2017 |
| CN | 107656434 | A | 2/2018 |
| CN | 207133769 | U | 3/2018 |
| CN | 208024101 | U | 10/2018 |
| CN | 208741330 | U | 4/2019 |
| CN | 109922621 | A | 6/2019 |
| CN | 208951088 | U | 6/2019 |
| CN | 209140097 | U | 7/2019 |
| CN | 209281687 | U | 8/2019 |
| CN | 110249271 | A | 9/2019 |
| CN | 110597042 | A | 12/2019 |
| CN | 210650610 | U | 6/2020 |
| CN | 111427251 | A | 7/2020 |
| EP | 1 249 741 | A1 | 10/2002 |
| EP | 1925998 | A2 | 5/2008 |
| EP | 2 874 022 | A1 | 5/2015 |
| EP | 3 599 519 | A1 | 1/2020 |
| JP | 2017-507333 | A | 3/2017 |
| TW | 201643060 | A | 12/2016 |
| WO | WO 2015/071719 | A2 | 5/2015 |

OTHER PUBLICATIONS

Japanese Office Action dated Jul. 12, 2022 in Japanese Patent Application No. 2021-118410 (with English translation), 9 pages.
Combined Chinese Office Action and Search Report dated Nov. 15, 2022 in Patent Application No. 202110994067.0 (with English translation of Category of Cited Documents), 10 pages.
Office Action dated Apr. 6, 2023, issued in corresponding Chinese patent application No. 202110944067.0 (with English translation).

* cited by examiner

DEVICE FOR FASTENING A BACK ON A MIDDLE FOR A TIMEPIECE

CROSS-REFERENCE TO RELATED APPLICATION

The present application claims priority to European Patent Application No. 20191389.4, filed Aug. 17, 2020. The benefit of priority is claimed to the foregoing, and the entire content of the foregoing is incorporated herein by reference.

FIELD OF THE INVENTION

The invention relates to a device for fastening a back on the middle of a watch.

The invention also relates to a timepiece, in particular a watch, including such a device.

BACKGROUND OF THE INVENTION

The external parts of watches and similar apparatuses obey many constraints, in particular water resistance, robustness, appearance, and must be produced in such a way as to prevent any involuntary dismounting resulting irreparably in an after-sales intervention for exchange of seals, cleaning, lubrication, even repair.

Some external or control components must, again, be angularly indexed relative to each other, for markings of the original, rest or actuation reference position, or else to facilitate the reading of indications or graduations, or to ensure the continuity of left and/or decoration surfaces. This angular indexing is often difficult to achieve properly, in combination with a good tightening of the components and with a perfect water resistance of the seals.

SUMMARY OF THE INVENTION

The invention proposes to achieve a tight and secure assembly of external components with easy to achieve angular indexing.

To this end, the invention relates to a device for fastening a back to a middle according to claim 1.

The invention also relates to a timepiece including such a fastening device.

BRIEF DESCRIPTION OF THE DRAWINGS

Other features and advantages of the invention will emerge more clearly upon reading the following description of a particular embodiment of the invention, given by way of simple illustrative and non-limiting example, and the appended figures, among which.

DETAILED DESCRIPTION OF THE PREFERRED EMBODIMENTS

Figure 1:
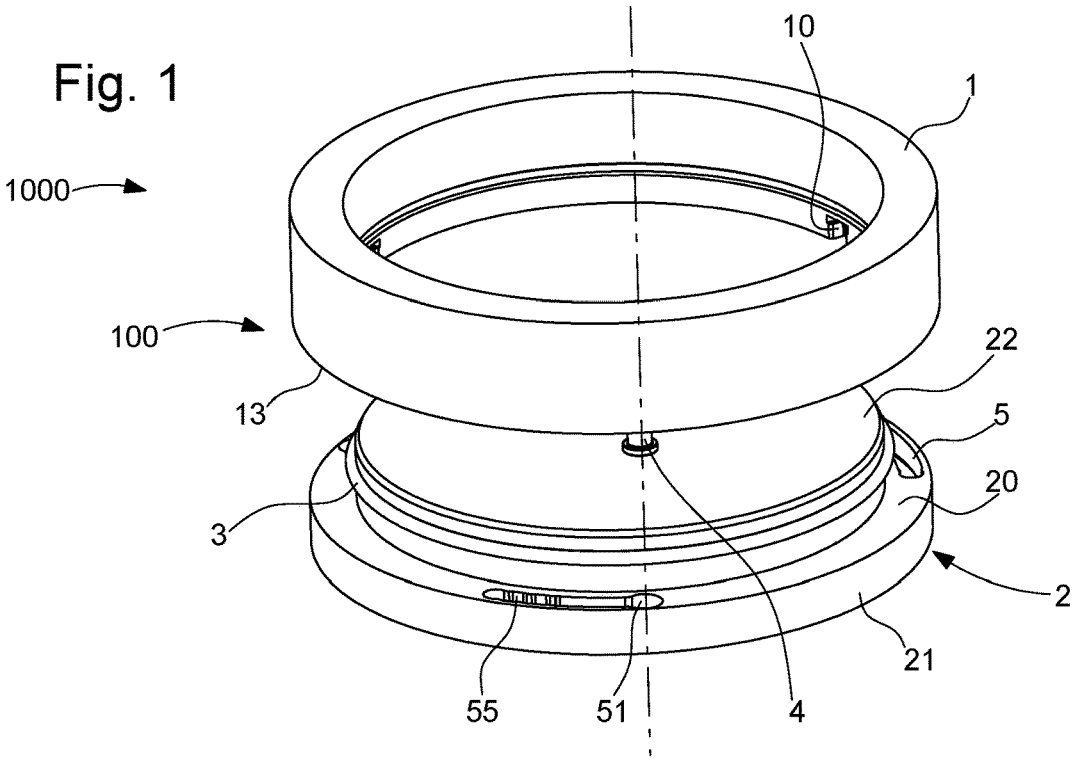
FIG. 1 is an exploded perspective view of a fastening device in accordance with the invention.

The invention proposes to achieve a sealed and secure assembly of external components with angular indexing which is easy to achieve and in a guaranteed position, with a minimum number of components.

FIGS. 1 to 5*b* illustrate the non-limiting example of the mounting and the angular indexing of a back relative to a watch middle.

The invention relates to a device 100 for fastening a back 2 on a middle 1 of a watch comprising at least one pin 4 integral with the middle, a seal mounted on the back, said back comprising, near its periphery, at least one groove arranged to cooperate with the pin. The back 2 comprises, near its periphery, at least one groove 5, the pin 4 being arranged to slide in the groove 5 between a first position, called the insertion position wherein the back 2 is free, and a second position called locking position wherein the back 2 is locked and positioned angularly relative to the middle 1, and in that said groove 5 comprises at least one bump 55 to form a hard point and increase the torque when the pin 4 passes through the bump 55.

Figure 2A:
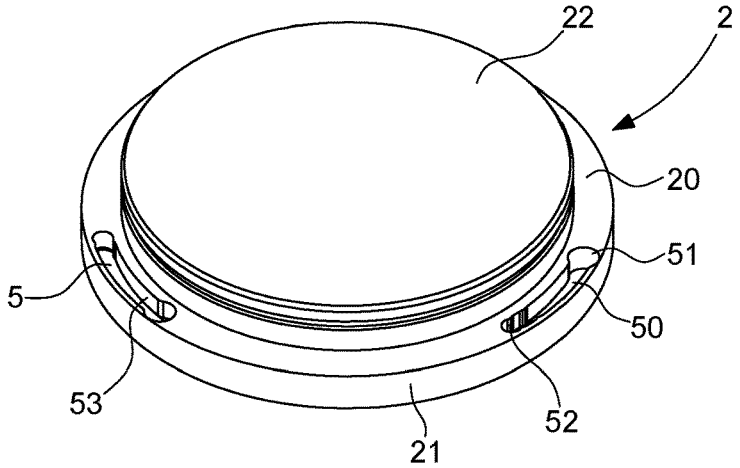
FIGS. 2*a* and 2*b* are respectively a perspective view of a back and a middle of a fastening device in accordance with the invention.
Figure 2B:
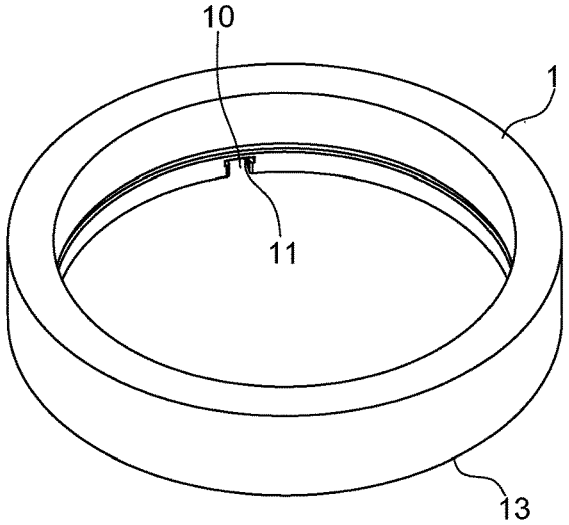

The back 2 is arranged to switch from a first dismounted insertion position, to a second mounted and locked position. As illustrated in FIG. 2*a*, the back 2 has a shoulder 20 forming a cover 21 arranged to cover entirely partly with the middle 1 and a body 22 arranged to rest in the middle.

In the first dismounted insertion position, the middle 1 and the back 2 have a first angular orientation relative to each other.

According to the invention, the back 2 comprises sealing means, such as an O-ring seal 3, at the interface between the middle and the back, the back having a slot for receiving the seal. Switching from the first dismounted insertion position to the second mounted and locked position is carried out under the action of forces exerted by an operator: an axial force to overcome the resistant force of the O-ring seal and assemble the back 2 and the middle 1, and a torque to bring them into an angular indexing position.

In the second assembled and locked position, the middle and the back have a second angular orientation relative to each other that is different from the first angular orientation. The back 2 and the middle 1 are held axially by means of a bayonet fit.

Advantageously, the securing of the back and the middle by a bayonet fit, in particular around an axial direction D, is reversible, and allows their dismounting. In a manner specific to the invention, this dismounting requires from an operator forces similar to those exerted during assembly, this dismounting preferably requires the use of a special tool, cooperating for example with holes or peripheral notches disposed on the visible face of the back 2. Such an assembly allows to prevent the back from being dismounted by the wearer, or a dismounting following a clumsiness or a shock.

According to the invention, this fastening device includes at least a third component, a pin 4, which is arranged to be interposed axially between the back 2 and the middle 1 and fixed in rotation relative to one of them, and which includes at least one elastically deformable area.

This pin 4 comprises a head 40, a body 41 and a foot 42 and is integral with the middle. As illustrated, the body 41, the head 40 and the foot 42 are cylindrical in shape, the body 41 having a diameter smaller than the diameters of the head 40 and the foot 42. The diameter of the head 40 and the foot 42 is provided identical, but it could very well be different, different geometric shapes could also be imagined for the pin 4, such as a body 41 of parallelepiped shape of square section.

According to a preferred embodiment of the invention, the pin 4 is mounted in the middle, the middle 1 comprising to this end a machining 10 with an opening in the shape of an inverted T for receiving the pin 4, the opening of the machining 10 opening inside the middle so as to make the assembly invisible. Advantageously, the machining 10 having at least one rib 11, and preferably two ribs, on the wall of the body of the T so as to perform an assembly by clipping the pin 4 into the machining 10, the head of the pin being housed in the head of the T-shaped machining.

The pin 4 can be made of different materials such as polyoxymethylene, polyurethane, a polymer-based material, or else elastomer, for example Asutane® or Hytrel® is known. The material selected allows to determine the maximum tightening torque, thus a pin 4 allows a tightening torque of around 1.5 N·m, lower than that usual for a back screwed onto a middle, for a conventional mounting. The advantage of such a pin 4, preferably in an elastic polymer material or the like, is its ease of housing it in a volume whose free space is limited, and where it is impossible to safely implant a metallic element susceptible to breakage.

Thus, the body 41 of the pin 4 is deformable and is arranged to oppose a resistive torque of variable moment to any relative tangential torque between the back 2 and the middle 1.

Figure 3A:
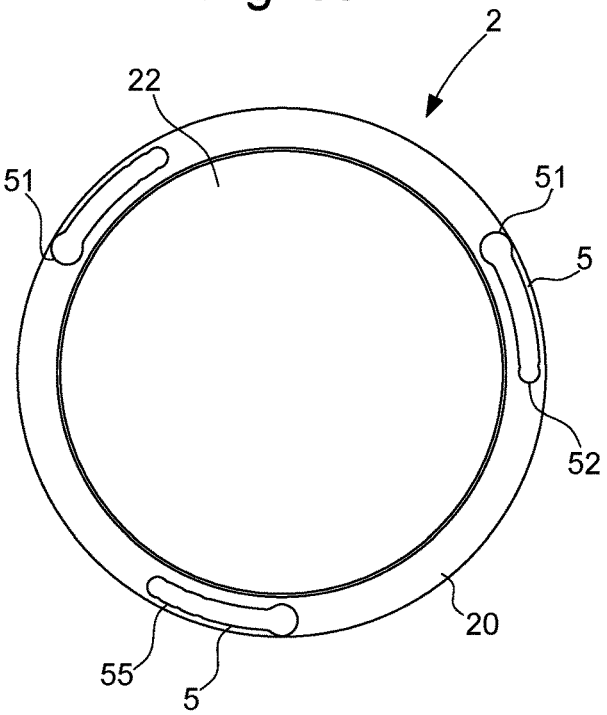
FIGS. 3*a* and 3*b* are respectively a top view of a back and a sectional view of FIG. 3*a* of the back of a fastening device in accordance with the invention.
Figure 3B:
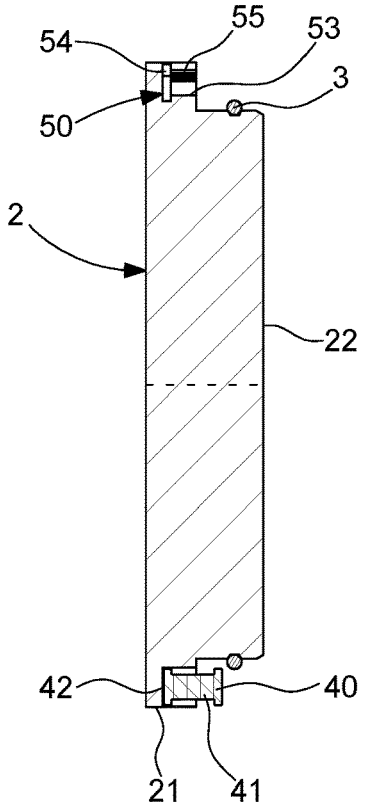
Figure 4A:
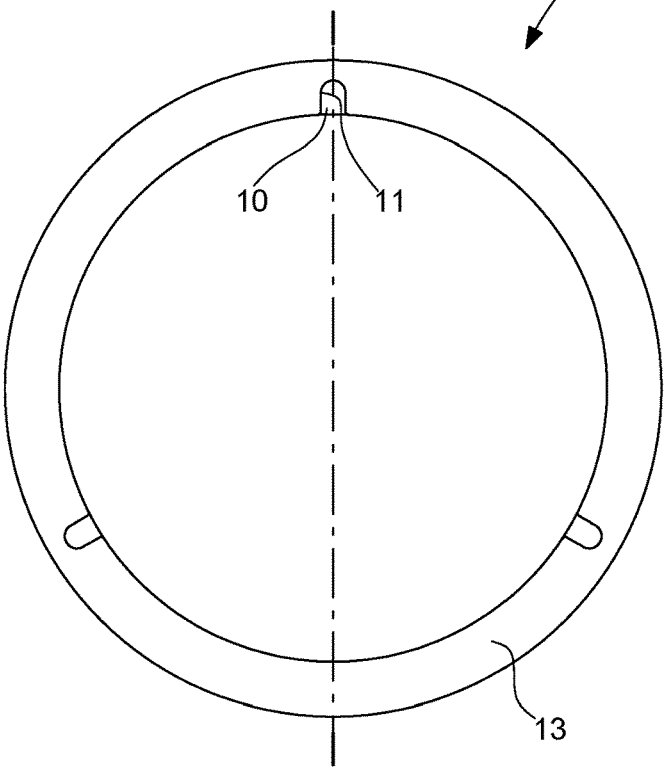
FIGS. 4*a* and 4*b* are respectively a back view of a middle and a sectional view of FIG. 4*a* of the middle of a fastening device in accordance with the invention.
Figure 4B:
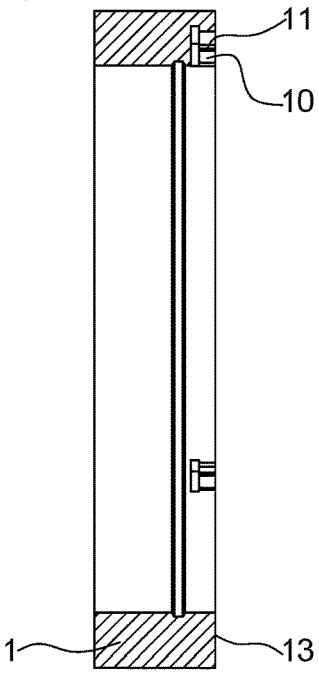
Figure 5A:
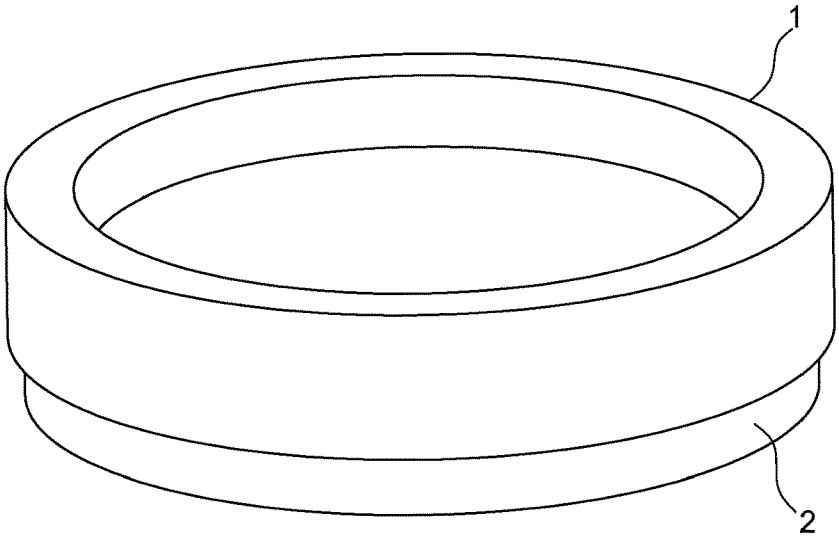
FIGS. 5*a* and 5*b* are respectively a perspective view of the assembled fastening device and a sectional view of FIG. 5*a;*
Figure 5B:
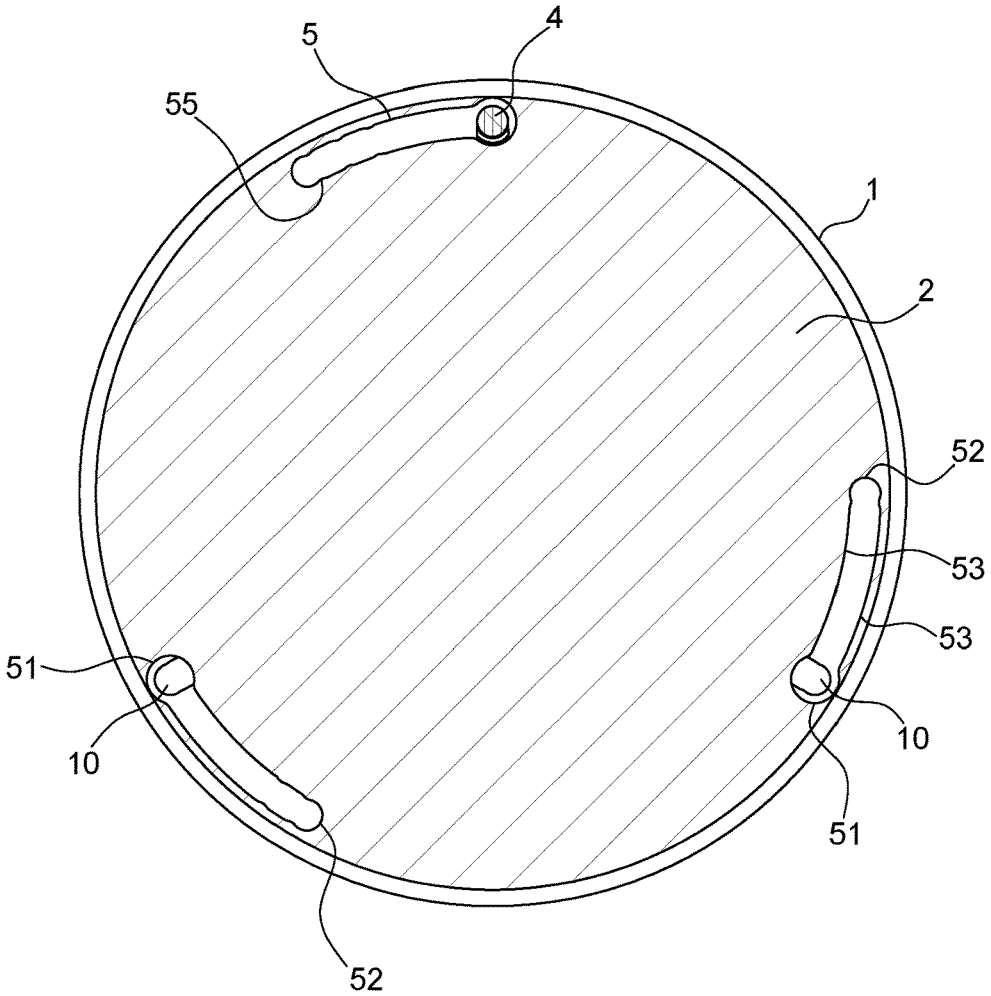

The body 41 of the pin is arranged to cooperate with at least one complementary relief, such as a bump 55, included in the back 2. As illustrated in FIG. 3*a*, the back 2 has near the periphery of the cover 21 at least one groove 5 which extends along a radius of the back 2 and has a depth at least equal to half the height of the pin 4, and a width of dimension equivalent to the diameter of the body 41 of the pin 4 so that the pin 4 slides within the groove 5. The groove 5 comprises a back 50, a first end 51 and a second end 52, and two walls 53, the back 50 of the groove being in the shape of a slot 54 whose width is equivalent to the dimensions of the head or the foot of the pin 4 so as to guide the pin and maintain it axially.

Thus, any passage of the pin 4 over the bump 55 in the groove 5 generates a resistive torque which tends to oppose the relative rotational movement between the middle 1 and the back 2.

According to a preferred embodiment, the groove 5 comprises a plurality of bumps 55, which are arranged to oppose a successive resistance during the passage of the pin 4. According to the invention, in the same groove 5, the angular distance between the successive bumps 55 is decreasing so as to oppose an increasing resistance, during a rotation between the back 2 and the middle 1. The angular distance between the successive bumps 55 can also be provided to be constant so as to oppose a constant resistive torque.

Figure 6:
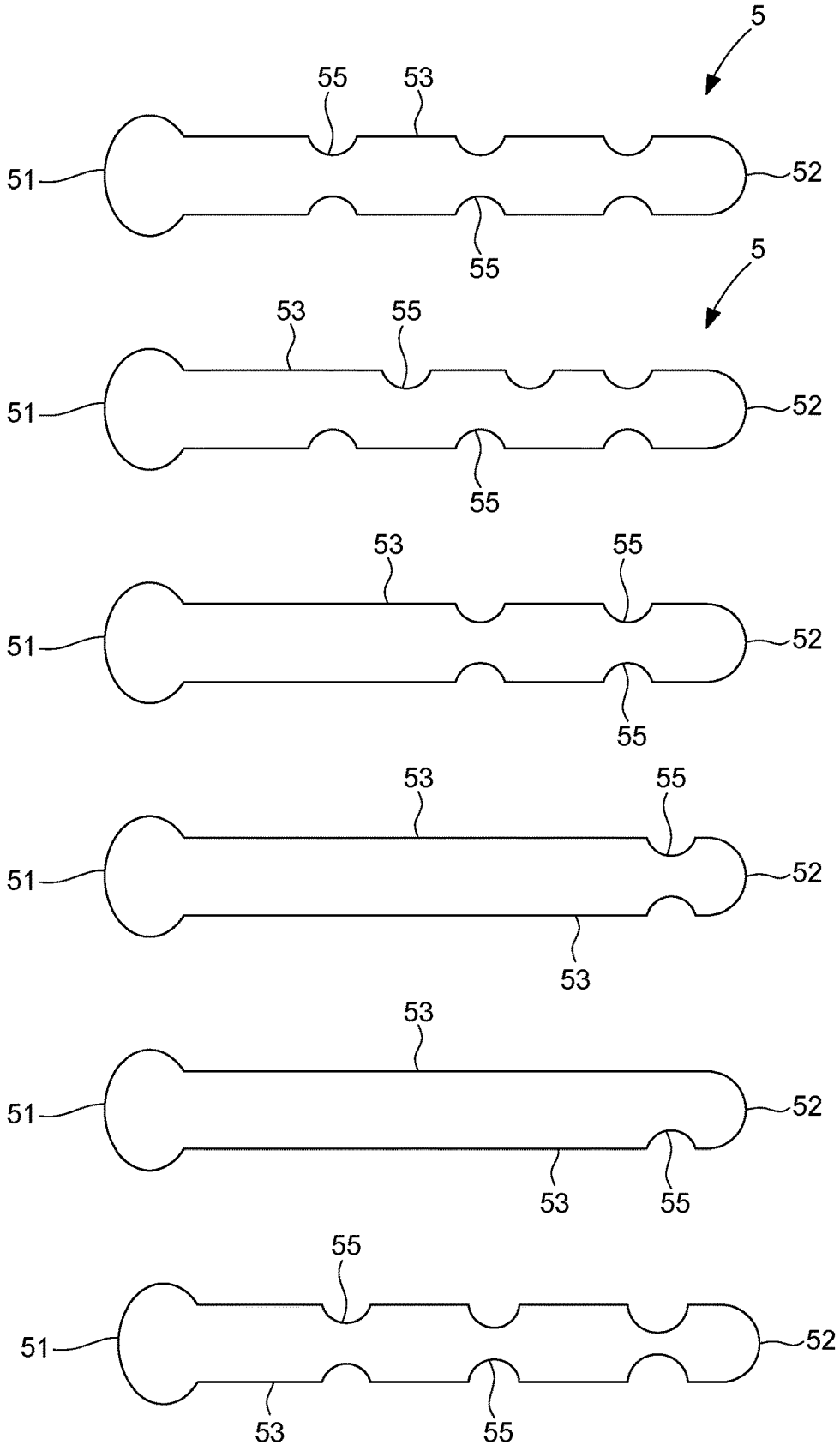
FIG. 6 shows the different possible embodiments for the groove of a fastening device in accordance with the invention.

Several configurations for the arrangement of the bumps are possible. According to a first embodiment, one or more bumps 55 are present on a single side wall of the groove 5. According to a second embodiment, one or more bumps are disposed on the two side walls of the groove 5, the bumps of each wall being disposed opposite each other. According to a third embodiment, one or more bumps are disposed on the two side walls of the groove 5, the bumps of each wall being offset from one another. Likewise, the distance between bumps positioned opposite each other can vary so as to provide a progressive resistive torque, as illustrated in FIG. 6.

The first end 51 of the groove 5 forms a space for the introduction of the pin 4, and the second end 52 forms a stop 6 and maintains the pin 4 in position in the groove 5. For this purpose, the first end 51 has dimensions similar to the head or the foot of the pin 4, and the second end 52 has dimensions similar to the body of the pin 4.

It is understood that the resistant force is all the more significant as the number of grooves 5, of bumps 55 and of complementary pins 4 in cooperation is high. It is therefore possible to act on the number of successive bumps, and/or on the number of pins and grooves. According to a preferred embodiment of the invention, the back comprises three grooves distributed angularly in a regular manner, and the middle comprises three complementary pins.

Naturally, the configuration can be reversed, with at least one groove machined in the middle and at least one pin integral with the back.

During assembly, the operator places the back on the middle so as to match the foot of the pin(s) with the first end 51 of the groove(s) 5 so that the pins are inserted therein when the operator imparts a translational movement on the back 2 to place the cover 21 of the back 2 near the lower edge 13 of the middle 1, so that the pin abuts against the back and thus ensures the water resistance thanks to the seal 3. The pin has a height very slightly greater than the distance between the back of the forge and the cover of the back, which avoids contact between the back and the middle, and a clearance of 0.02 mm to 0.04 mm is present between the back and the middle.

Then the operator imparts a progressive torque to impart the relative rotation between the middle 1 and the back 2; during this rotation, the operator performing the assembly encounters a first resistance when the body 41 of the pin 4 cooperates with the first bump 55 of the groove 5. Thus, the resistive torque increases during the relative rotation.

In a first scenario, the first bump 55 cooperating with the pin is unique. In a second scenario, the groove comprises several bumps 55 so that the operator provides a jerky force during the rotation, the peak of the cumulative resistive torque increasing during each passage of a hard point, to reach, at the indexing angle, the maximum value. The operator thus experiences a feeling of increasing resistance, up to the stop 52.

As illustrated in the figures, the back 2 comprises three grooves 55, distributed at 120°, each of the grooves being arranged to cooperate with a pin 4 complementary to the groove. The middle thus comprises three pins distributed at 120°, and the operator feels a single passage of a hard point when the three pins at 120° pass a bump 55 simultaneously.

The water resistance exists as soon as the back is placed on the middle, and the mechanism according to the invention is arranged so that, as in the previous case of a single bump, securing the water resistance of the seal(s) is ensured as soon as the back is inserted into the middle, and then no loosening can occur without voluntary action by an operator.

In practice, very good results are obtained with at least two, and preferably three, or even four, successive bumps, so as to provide an elementary angular travel sufficient for the passage of each bump.

The invention requires, during assembly, the successive crossing of several bumps so as to form an increasing resistance, but also when dismounting, because, from the indexed final position, in particular on the mechanical stop, any application of a sudden force results, in the worst case, by crossing a single bump 55, without total disassembly, with a visual shift, but above all without loss of water resistance or risk of pollution of the interior of the watch. In the example illustrated, even when the operator successively crosses three thresholds, optically visible due to the offset, the water resistance is still ensured. To have a loss of water resistance, the operator must partially remove the back so that the seal is no longer compressed, the seal not being impacted by the rotation of the back.

According to one embodiment, the distance between each bump 55 is identical, and its passage opposes the same resistive torque.

In an advantageous variant, the distance between each bump is decreasing, and the operator must apply an increasing torque, as in the example of the three bumps 55 in FIG. 3*a*.

The invention is advantageous because it is perfectly compatible with watch dimensions, while having a capacity for a high resistant force, which can reach a few N·m.

Moreover, in the case where the timepiece is subjected to particular large-scale constraints, the dismounting of the mechanism according to the invention requires maintaining the application of any force of accidental origin during a significant angular travel, from 5 to 10° for crossing a single bump in the example illustrated, safety still remaining ensured if several bumps follow one another.

According to the invention, the angular indexing is guaranteed by the second end 52 which forms a stop 6 for limiting the travel.

The invention thus allows to prevent any unexpected and involuntary dismounting of the back of the middle, for example under the effect of vibrations, of successive expansion cycles, by inadvertent use of the wearer, or the like.

Preferably, the dismounting requires a special non-marketed tool, which ensures that the maintenance is carried out by after-sales personnel having the required qualifications.

The invention lends itself well to cases where the middle and the back are made of different materials, with different expansion coefficients, or even fragile or hard materials (ceramic, sapphire), which do not allow standard fastening modes. Conventional configurations include the assembly of a gold middle with a sapphire back, or an entirely ceramic case, a metal-ceramic combination, or the like.

An important advantage of the invention is to eliminate any contact/friction between the back and the middle and thus prevent the appearance of residues due to friction and the addition of a grease to trap them as is the case in the prior art.

Another important advantage of the invention is that it provides increased safety when opening thanks to the successive passage of several notches and the obligation to at least partially remove the back before any loss of water resistance.

The invention also relates to a timepiece or watch 1000 including such a fastening device 100.

In short, the invention allows to provide a fastening device whose design is compact, which maintains the water resistance of the watch, which it protects against accidental dismounting.

The invention also allows to ensure the perfect orientation of a component maintained blocked in its service position.

The invention provides many advantages:

from a first relative angular position, between the back and the middle, where the water resistance function is ensured, for example as soon as the compression of a seal is performed, there is, in the mechanism according to the invention, a broad range of relative angular values between the back and the middle, wherein the water resistance remains guaranteed, for example by several tens of degrees, which is important in comparison with, for example, a standard screwed back in the case of a middle-back sub-assembly, where unscrewing only a few degrees leads to the loss of water resistance and the need for cleaning and a new seal, whereas according to the invention it is only after the passage of the very last notch during the dismounting that the loss of water resistance becomes possible if the rotation is continued and the back 2 is started to be extracted from the middle 1;

a closing by succession of notches which has a widely dimensioned closing torque for the back, both sufficient and acceptable for such a mounting, thanks in particular to the multiplication of the number of bumps distributed in the groove, with, for the operator, a feeling of screwing in steps of increasing the closing torque to the desired position, deemed to be the closed position, which is also clearly perceptible;

an opening safety, which is increased by two factors: the need for the operator to provide significant positive energy to pass a notch, and the successive passage of several notches prior to any loss of water resistance.

The invention claimed is:

1. A device for fastening a back on a middle of a watch, the back having a shoulder forming a cover arranged to cover entirely or partly with the middle and a body arranged to rest in the middle, said device comprising:

at least one pin integral with the middle, a seal mounted between the back and the middle, wherein said back comprises, near its periphery, at least one groove, the pin being arranged axially between the back and the middle and being arranged to slide in the groove between a first position in which the back is free, and a second position in which the back is locked and positioned angularly relative to the middle, and said groove comprises at least one bump to form a hard point and increase a torque when the pin passes through the bump.

2. The device for fastening the back on the middle of the watch according to claim 1, wherein the pin is mounted in the middle, said pin having a body, a head at a first end of the body, and a foot at a second end of the body, the body having a diameter smaller than diameters of the head and the foot.

3. The device for fastening the back on the middle of the watch according to claim 2, wherein the middle comprises a machining with an opening in a shape of an inverted T for receiving the pin, said machining having at least one rib so as to perform an assembly by clipping the pin into the machining.

4. The device for fastening the back on the middle of the watch according to claim 3, wherein the opening of the machining opens inside the middle.

5. The device for fastening the back on the middle of the watch according to claim 1, wherein the pin is made of a rigid and elastically deformable material.

6. The device for fastening the back on the middle of the watch according to claim 5, wherein the elastically deformable material is polyoxymethylene, polyurethane, a polymer-based material, or an elastomer material.

7. The device for fastening the back on the middle of the watch according to claim 1, wherein the pin is machined with the middle, the assembly forming an integral element.

8. The device for fastening the back on the middle of the watch according to claim 1, wherein the groove extends along a radius of the back and has a depth at least equal to half the height of the pin, and a width of dimension similar to the diameter of the body of the pin so that the pin slides within the groove.

9. The device for fastening the back on the middle of the watch according to claim 1, wherein the groove comprises a back, a first and a second end, and two walls, the back being in the shape of a slot to the dimensions of the head or the foot of the pin so as to guide the pin and maintain it axially.

10. The device for fastening the back on the middle of the watch according to claim 9, wherein the first end forms a space for the introduction of the pin, and the second end forms a stop and maintains the pin in position.

11. The device for fastening the back on the middle of the watch according to claim 9, wherein the first end has dimensions similar to the head or the foot of the pin, and the second end has dimensions similar to the body of the pin.

12. The device for fastening the back on the middle of the watch according to claim 9, wherein the bump is formed on one of the two walls of the groove.

13. The device for fastening the back on the middle of the watch according to claim 1, wherein the groove comprises several bumps, the distance between each bump being identical.

14. The device for fastening the back on the middle of the watch according to claim 1, wherein the groove comprises several bumps, the distance between each bump being decreasing.

15. The device for fastening the back on the middle of the watch according to claim 1, wherein the device comprises at least three pins distributed angularly on the back and disposed at regular intervals.

16. A timepiece comprising the device for fastening the back on the middle of the watch according to claim 1.

17. The device for fastening the back on the middle of the watch according to claim 1, wherein the pin extends downward from a bottom face of the middle.

18. The device for fastening the back on the middle of the watch according to claim 1, wherein the seal is mounted on the body of the back and the groove is located radially outside of the seal.

* * * * *